United States Patent [19]

Anderson

[11] 4,420,794

[45] Dec. 13, 1983

[54] INTEGRATED CIRCUIT SWITCH

[75] Inventor: James R. Anderson, Minneapolis, Minn.

[73] Assignee: Research, Incorporated, Eden Prairie, Minn.

[21] Appl. No.: 300,965

[22] Filed: Sep. 10, 1981

[51] Int. Cl.[3] ..... H05F 5/100

[52] U.S. Cl. ..... 361/419; 70/DIG. 46; 307/10 AT; 340/825.5; 361/380; 361/405

[58] Field of Search ..... 174/52 FP; 361/171, 361/172, 380, 394, 400, 403, 405, 417–419; 307/10 AT; 70/277, DIG. 46; 340/149 R, 149 A, 147 R, 147 LP, 825.31; 235/439–443

[56] References Cited

U.S. PATENT DOCUMENTS

| | | | |
|---|---|---|---|
| 3,134,254 | 5/1964 | Richard | 70/277 |
| 3,347,072 | 10/1967 | Rose | 70/277 |
| 3,392,588 | 7/1968 | Hedin et al. | 70/277 |
| 3,651,464 | 3/1972 | Hedin et al. | 340/149 R |
| 3,660,831 | 5/1972 | Nicola et al. | 340/274 |
| 3,673,467 | 6/1972 | Eisenreich | 317/134 |
| 3,686,659 | 8/1972 | Bostrom | 340/274 |
| 3,851,314 | 11/1974 | Hedin | 340/147 |
| 4,095,791 | 6/1978 | Smith et al. . | |
| 4,149,027 | 4/1979 | Asher et al. . | |
| 4,232,353 | 11/1981 | Mosciatti et al. . | |
| 4,297,569 | 10/1981 | Flies . | |
| 4,326,125 | 4/1982 | Flies | 361/171 |

*Primary Examiner*—G. P. Tolin

*Attorney, Agent, or Firm*—Kinney, Lange, Braddock, Westman and Fairbairn

[57] ABSTRACT

A key device carries an integrated circuit chip or dual in-line package (DIP) and permits connecting the chip into a circuit board such as a logic circuit board of a computer terminal, from an exterior opening of the housing or cabinet carrying such circuit board. The key device connects any desired chip electrically to spring contacts of a socket located in alignment with the exterior opening. The socket in turn is connected through a ribbon cable for example to a connector on the circuit board at some desired location within the housing. The chip carrying key device is rotated 90° after insertion to insure good electrical contact. When the key is to be removed, the key device is rotated 90° to a position where it is electrically disconnected from the socket leads and can be removed from the housing. The chip can be reprogrammed if desired. Various applications can be utilized where the user for example can insert a discrete memory chip into a computer terminal logic circuit to identify the user before allowing the user to transact business through the computer, or for rapid change of off the shelf chips or reprogrammed memories into circuit or logic boards used in a wide variety of devices.

10 Claims, 6 Drawing Figures

INTEGRATED CIRCUIT SWITCH

BACKGROUND OF THE INVENTION

1. Field of the Invention

The present invention relates to a key device for insertion and removal of an electronic circuit chip or dual in-line package into a connector of a circuit board from the exterior of the housing.

2. Description of the Prior Art

In the prior art, electronic key-like devices used with various security systems have been advanced. The keys for such devices have been molded and include circuits representing personalized codes or information so that when the key is inserted into a mating component the circuit on the key will either complete certain circuitry remote from the key or will identify the key user and will permit the holder of the key to either unlock locks, or to make transactions similar to that done with a credit card.

One such device is sold by Data Key, Inc., 7710 Computer Avenue, Minneapolis, Minnesota and is marketing under the Trademark DATA KEY. The "key" that is used is a single individual molded key carrying data access information or an individual digital code. The key in one form comprises a random access memory and is inserted into a suitable socket for identification purposes to permit the operator of the key to perform certain tasks. However, the key itself is individually molded with the particular memory circuit integrally formed as a part of the key. The key receptacle which interfaces with the key includes read/write heads to decode the information on the key directly and transmit that information to remote electronic packages for operation of the remote systems that are coupled to the key receptacle.

The device does not lend itself to using standard off the shelf chips such as programmable read only memories (PROM) or other integrated circuits, and quickly connect them into logic boards in various electronic devices. In particular, the DATA KEY does use an electrically alterable read only memory and ties into a micro processor to process the information and provide outputs as desired.

The device is acknowledged as prior art to the present application. An article relating to the device appeared in The Minneapolis Star on Tuesday, Apr. 28, 1981. Further, advertising literature put out by Data Key, Inc. describes various processes the unit can be utilized for, including information comprising their document Nos. 221-0002 through 221-0007.

Additionally, various security locking systems utilizing keys that carry electronic components have been advanced. For example, an electronic solid state lock mechanism is shown in U.S. Pat. No. 3,347,072. This device merely has a key that carries battery cells that power a latch release mechanism when properly inserted into its receptacle.

A binary coded electonic lock and key is shown in U.S. Pat. No. 3,392,558, which reissued as U.S. Pat. No. Re. 27,013. This key is an insertable member which establishes a binary code that is recognized by remote circuitry, and if the code on the key is proper the key will permit opening a lock. A resistively-coded security system is shown in U.S. Pat. No. 3,673,467 wherein a security system has a key that has a plurality of electrically resistive elements on it that complete external circuitry when the key is inserted. A reprogrammable electronic identifying secuirty system is shown in U.S. Pat. No. 3,851,314. A key carrying a binary coded circuit also is shown in U.S. Pat. No. 3,651,464. A locking system which responds to a key that carries capacitance or resistance devices is shown in U.S. Pat. No. 3,134,254. An anti-theft device operated by a key is shown in U.S. Pat. No. 3,660,831. The key has electronic contacts wherein the keyhole and key have two positions such that the insertion of the key in a first position actuates the circuitry in a prealarm state so that unauthorized tampering will sound an alarm. Similar electronic locking devices are shown in U.S. Pat. Nos. 3,686,659 and 4,232,353.

Interchangeable modules for electronic games, such as video games, wherein cartridge printed circuit boards are inserted, are shown in U.S. Pat. Nos. 4,095,791 and 4,149,027.

Each of the prior art devices, however, fails to suggest or teach the use of a device which carries, on a simple key base integrated circuit chips that can be "off the shelf" and readily inserted into a receptacle comprising spring contacts of a socket that is remotely connected to a circuit board so that the logic devices or other integrated circuit components needed for operating a particular unit can easily be interchanged, replaced or removed for locking.

SUMMARY OF THE INVENTION

The present invention relates to an integrated circuit switch which permits connection of selected different integrated circuits on dual in line packages (DIPs) into an internal circuit board from the exterior of a housing or cabinet. The key base permits mounting any desired integrated circuit chip on a key device for connection to the internal circuits of an electronic module.

An access opening for receiving the key device is provided on the electronic module. The key device is inserted, and subsequently rotated to effect an electrical connection from the leads of the integrated circuit on the key base to corresponding leads, which in turn are connected through a jumper cable to a circuit board. The key device can carry a logic circuit, a memory chip of some desired type, or any other integrated circuit, on a dual in-line package (DIP), that activates, programs or controls a remote circuit board of the electronic module.

The key device comprises a key base on which the DIP is mounted merely by placing the contacts of the integrated circuit chip or package on opposite sides of a generally flat insulated carrier and bending the contacts to firmly connect the unit to the key base. If desired, the contacts may be permanently attached by cementing the DIP in place. Normally the key base will have grooves or serrations on its edges and one contact is placed in each serration to keep the contacts separated. When the key is inserted into the receptacle for receiving it, the serrations also serve to receive separate internal contacts to which connection is made. Upon rotation of the key the contacts of the integrated circuit wipe against the contact leads within the housing to insure good electrical contact each time the key is operated.

The structure is easily made, and has a wide application in permitting changing of memories or other circuit chips. Also computer security may be obtained, because a discrete memory chip can be inserted into the internal circuit and also removed from a computer terminal logic circuit to serve to identify the user, or to complete the internal circuitry for use. Only a person having the proper key can utilize the circuitry.

The device also can be used to implement changes in computer games by inserting a new memory chip into the game logic board. Because the device utilizes standard components which are readily available, the costs are kept low and the flexibility and adaptability is greatly increased because of the wide variety of various integrated circuits that can be incorporated into the concept.

DETAILED DESCRIPTION OF THE PREFERRED EMBODIMENT

Figures 1, 2, 3:
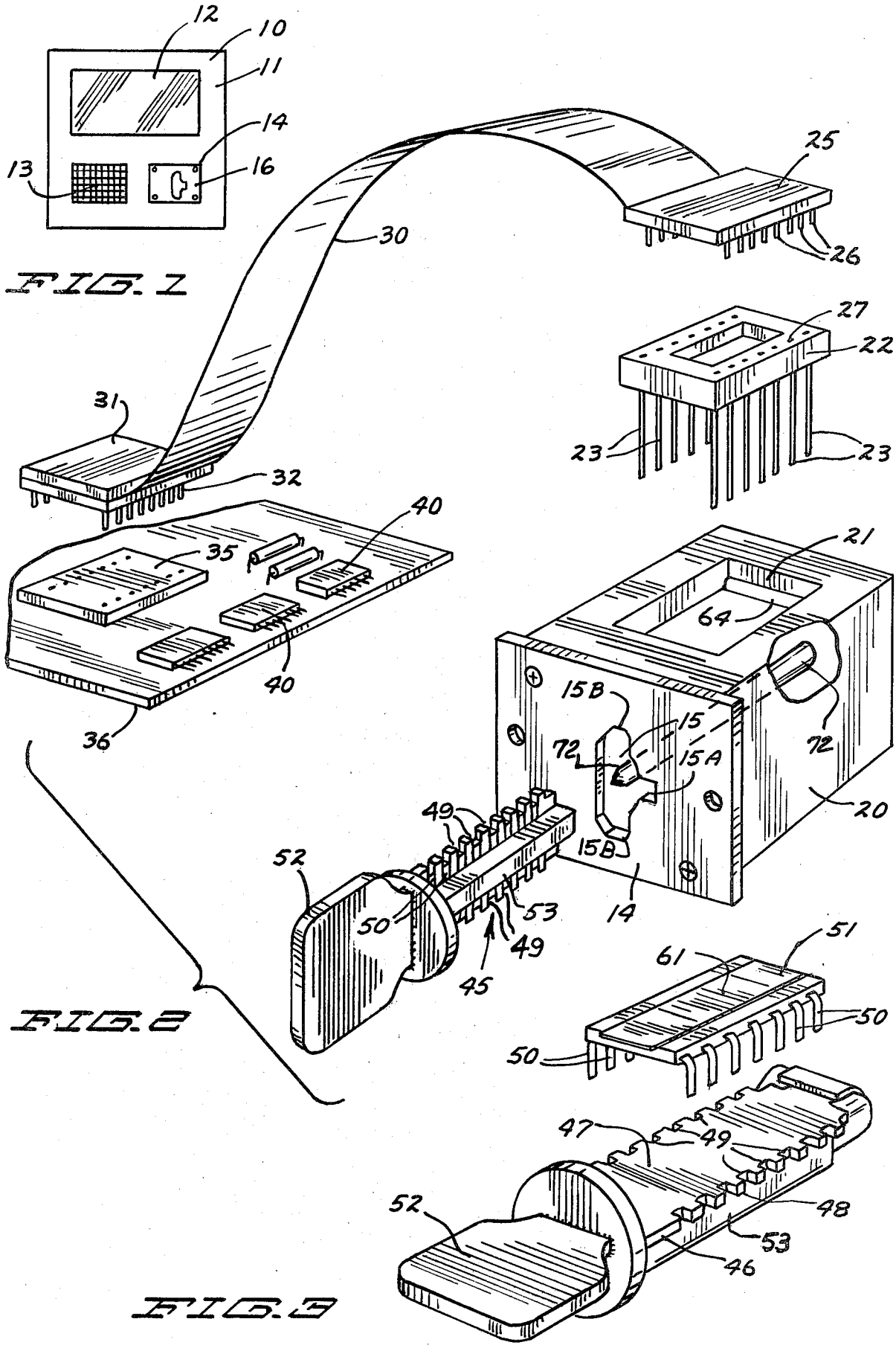
FIG. 1 is a view of a typical electronic unit having an integrated circuit switch made according to the present invention installed therein.
FIG. 2 is an exploded view illustrating the preferred components utilized in operation of the integrated circuit switch of the present invention.
FIG. 3 is an exploded view of a typical key assembly utilized with the integrated circuit switch of the present invention.

An electronic component indicated at 10 such as a microprocessor, a data processing peripheral, a terminal or a video game for example has an outer cabinet 11. A CRT display 12 and various controls 13 are illustrated by way of example. Additionally, the component 10 includes an indicated circuit switch assembly 16 made according to the present invention including a housing having an external mounting flange 14 with a key slot 15 opening to the exterior of the housing 11 in a desired location. The key slot 15 is used with the electronic switch of the present invention.

Referring to FIG. 2 for example the mouting flange 14 is connected to a housing 20 which includes a receptacle 21 on one side that is adapted to receive a wire wrap socket 22 of conventional design. The socket 22 as shown has a plurality of spring contactors or leads 23 on opposite sides thereof, which extend from the socket into the interior of the housing.

The socket 22 in turn has a plurality of receptacles on the top to receive a mating connector 25. The connector 25 has depending connecting pins 26 that fit into receptacles 27 in the top of the socket. Each of the pins 26, when inserted into a mating receptacle 27 is electrically connected to a corresponding one of the leads 23. Each of the pins 26 also connects to an individual wire in a ribbon cable 30, comprising a jumper cable, that has another plug or connector 31 at the opposite end thereof having pins 32. Each of the pins 32 is connected to a corresponding pin 26. The plug or connector 31 fits into a socket 35 which is part of a circuit mounted on a circuit board 36. The socket 35 in turn has individual receptacles for receiving the pins 32 and connecting, therefore, each of the leads 23 to an individual circuit path or connection on the circuit board 36. As shown, the circuit board 36 carries various integrated circuit components 40, and in the example to be discussed comprises a logic board which requires a memory chip, such as a PROM connected to the socket 35 to be operable.

The key slot opening 15 is made of a size and shape to receive an integrated circuit key assembly indicated generally at 45. Key assembly 45 in the form shown includes a key base 46 that has a generally planar support platform 47, and narrow edge portions 48 that are serrated with spaced grooves 49. The grooves 49 are of size and spacing so each groove receives a contact strip 50 of an integrated circuit chip 51 of conventional design. The integrated circuit chip 51 is a dual in-line package (DIP) of standard design having the desired number of contacts for standard connections in the data processing industry. What is contained to the chip is limited only by the needs of the user. The DIP is generally a flat package that rests flat on the planar platform 47. Additionally, the key base 45 includes a handle 52, and a rib 53 that fits into a portion 15A of the key slots so that the key has a cross sectional profile that is unique to the opening 15. A cylindrical opening 65 is centered along the longitudinal axis of the key and forms a guide receptacle as will be explained.

Figure 5:
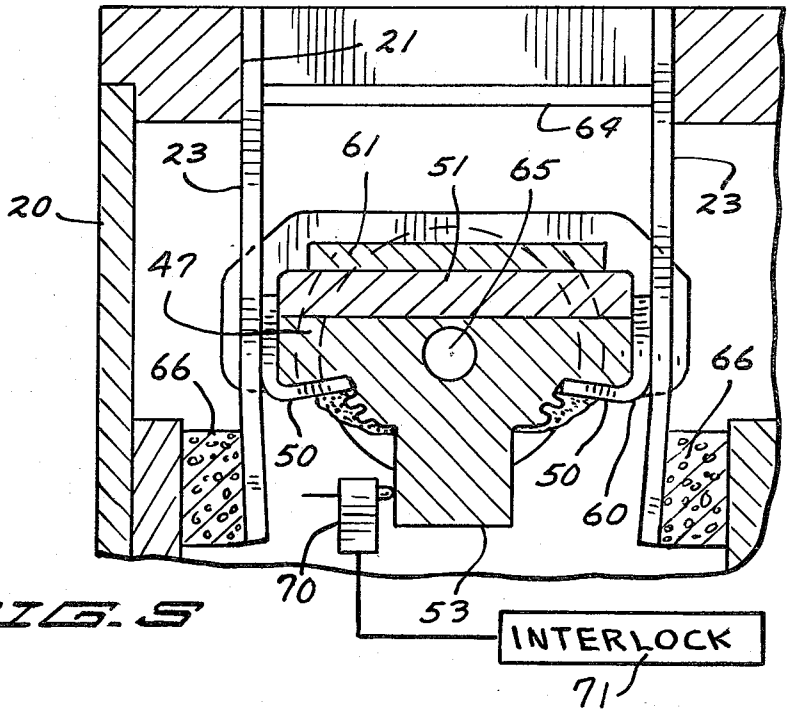
FIG. 5 is a sectional view taken as on line 5—5 in FIG. 4.
Figure 4:
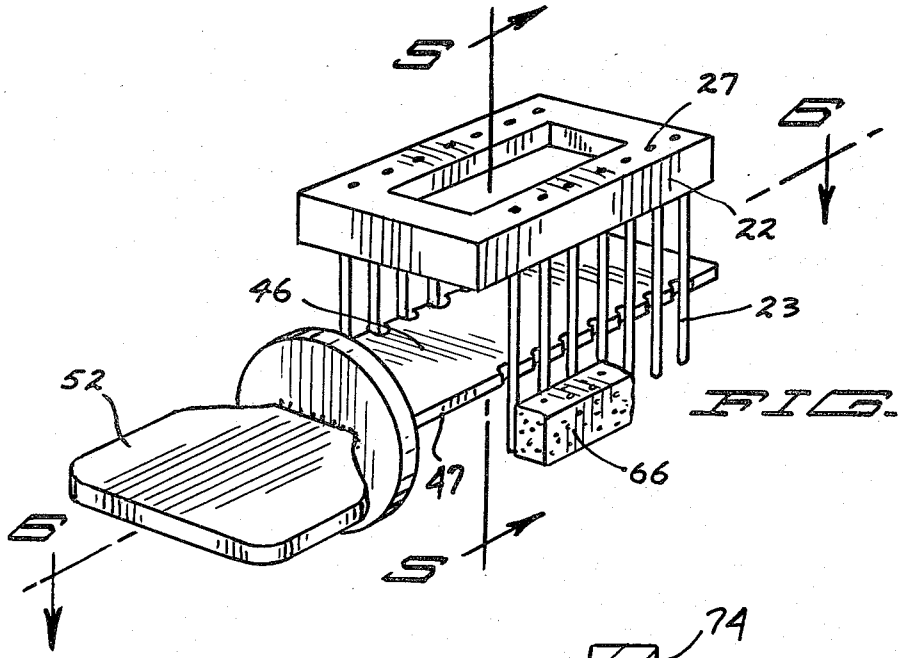
FIG. 4 is a part schematic, perspective view showing the integrated circuit switch key in position in a typical socket used in the assembly.
Figure 6:
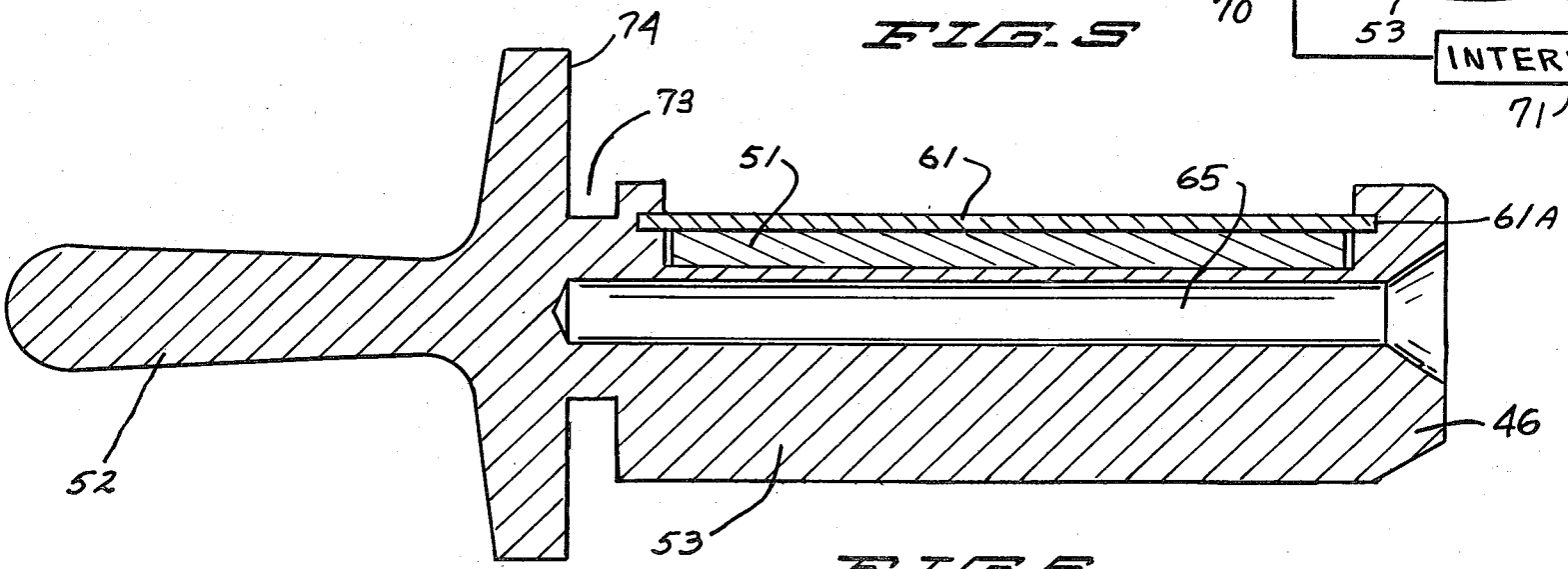
FIG. 6 is a sectional view taken generally along line 6—6 in FIG. 4.

The key base 45 can be made in various ways out of insulating material, but preferably would be injection molded. The flat platform 47 is made so that it will adequately and securely support the base of an integrated circuit chip or DIP 51 and when the base of the DIP is placed into position with each of the contacts 50 passing through one of the grooves 49, the contacts 50 can be bent over onto the opposite side of the flat platform 47 as shown in FIG. 5 for example so that the body of the DIP 51 is held tightly against the flat surface of platform 47. If desired, the outer end portions of the contacts 50 can be cemented to the key base, when the contacts are bent as shown in FIG. 5. Note that the underside surfaces adjacent the edges of the key base, where the contacts 50 rest, taper back toward the platform 47 slightly to provide a relatively sharp bend of more than 90° at the corner shown at 60 so that the contacts 50 will take a permanent set and hold the integrated circuit chip tightly against the upper surface of the platform 47. Also, as shown, the ends of the contacts can be connected to the key base if desired.

The DIP 51 can have a protective cover indicated at 61 placed over it to prevent physical damage when the key assembly including the DIP is inserted into the opening 15.

The grooves 49 as shown are spaced an amount corresponding to the standard spacing for DIP contacts 50, as well as for the contact leads 23 of a standard integrated circuit wire wrap socket 22.

The socket 22, as shown in FIG. 5 is supported in aperture 21 of housing 20 on a suitable support rib 64 at the ends of the aperture, and is held in a suitable manner. For example the socket 22 can be mechanically held in aperture 21 with suitable retainers or may be cemented in place if desired.

The contacts 23 on opposite sides of the socket 22 depend from the opening 21 in the housing 20. The contacts 23 are centered on the central axis of the guide opening 65.

The contacts 23 extend downwardly in the housing 20 and are retained resiliently from spreading outwardly excessively by suitable resilient pads 66, 66 on opposite sides of the housing. The pads 66 are supported on the housing wall in a suitable manner. The pads 66 form resilient supports for the lower ends of the contacts 23 so that they will not be bent outwardly excessively when the key assembly is put into use. The pads 66 can be made of a suitable foam material, for example, and should be insulating material that is relatively soft so that the contact leads will be urged inwardly under some low level force to aid in making good contact between contacts 23 and the contacts 50 from the integrated circuit.

Once the desired integrated circuit chip has been placed onto a key base 45, and the appropriate accommodations made to connect contacts 23 to the proper places on the circuit board 36, the key can be inserted into the opening 15 as shown in FIG. 2. As the key is inserted into the housing a guide shaft 72 fits within the opening 65 to support and guide the key properly. As the key is inserted, the plane of the platform extends vertically so the grooves 49 are facing up and down. The edges of platform 47 are received in a portion of the key opening 15 indicated at 15B while the rib 53 is received in the opening 15A. It can be seen that one of the contacts 50 is placed in each of the grooves 49 and when the key has been moved into operating position in the opening 15, a groove 73 which forms a cylindrical or annular surface at the base end of the key will align with and receive the flange 14 adjacent to the opening 15. The key locating surface 74 rests on the outer surface of flange 14 to insure that the key will be inserted properly to make sure the grooves 49 and contacts 50 are aligned with the proper socket leads. The distance from the outer surface of the flange to the socket leads is precise and the surface 74 also can be precisely located with respect to the grooves 49 on the key. The groove 73 closely fits over the flange 14 for proper location as the key is rotated. Thus the key is accurately located in housing 20 in direction along its longitudinal axis.

When the groove is seated on flange 14 the key assembly will be rotated and as this is done, the contacts 23 (which as shown are the elongated leads of the conventional wire wrap socket) will be properly guided into the grooves 49 on the edges of the key base platform 47 so that the contacts 23 remain separated. As the key is rotated the portions of contacts 50 of the integrated circuit that are in the grooves 49 will wipe against the contacts 23 to assure a good electrical contact between the contacts 50 and the contacts 23.

Once the key has been rotated 90° so that electrical connections are made between the contacts 50 and the contacts 23, the integrated circuit carried thereon will thus be connected into the socket 35 and the appropriate circuitry on circuit board 36. The data or components on the integrated circuit or DIP 51 will be entered into the circuit for the electronic unit 10 and the unit can be used in a desired manner.

When the unit 10, such as the computer terminal and its associated circuitry, is to be disabled or the programming is to be changed, the key assembly merely is rotated to permit removal of the key assembly and the circuit carried by it. The overall circuit thus has a missing component to prevent its use. If the chip is a ROM, programming may be changed by removing the old chip from the key base and replacing it with a new ROM having a different program. A second key with a new program also can be used. Further, a PROM chip can be reprogrammed without removing it from the key and housing. The cable end 31 can be plugged into a "PROM burner" with the new program loaded in the memory.

In FIG. 5 a microswitch 70 is illustrated as being tripped when the key assembly is in proper position to connect the DIP 51 into the circuit. The microswitch 70 can be used to control an interlock circuit 71 to shut the entire unit down whenever the key assembly is not in place. This provides an additional security or safety factor as well as providing a means of activating an alarm to indicate when a key is inserted. Thus for example, if an illegal key was inserted an alarm could be armed by microswitch 70, and only connection of a proper DIP 51 would disable the alarm. If an illegal key was inserted and the incorrect DIP 51 connected in the alarm would activate.

If the key assembly and its circuit is used for identification purposes, the circuit on DIP 51 can be programmed to give a discrete readout of information that identifies the holder of the key. The circuit on the key can also be programmed so that it will activate a display on the CRT 12 that gives the holder of a key information that is needed for the operations desired.

Thus, the device of the present invention provides for low cost, rapidly changeable programming for accomplishing all of the purposes of the prior art in a much simplier, more direct, and more readily accessible manner.

The changing of programs or other circuits is easily done with the present invention without the need for a skilled technician. Using the present invention an untrained user can insert any integrated circuit desired into a circuit board without error and without damage to the circuits.

The flat platforms of the key base and the overhanging edges permit easily fastening the circuit leads of a DIP circuit by bending the connections over the edges. The grooves in the edges also properly locate the circuit on the key.

The chip can also be an electrical alterable read only memory (EAROM). The EAROM can receive its program from the associated circuit board circuitry and the memory in the EAROM "saved" electrically before the key is removed from the housing. The program on the EAROM cannot then be duplicated by another user, and the involved unit will be operable only with the one key.

What is claimed is:

1. An integrated circuit switch comprising a housing having an opening therein, means in said housing for providing a plurality of individual first electrical contacts arranged in a pair of spaced rows of first contacts, a key assembly including a key base having a platform portion with an external surface forming a support and external side edge portions having grooves defined therein and spaced to correspond to the spacing of the first contacts in the respective rows, a dual in-line package supported on the external surface and having an electrical circuit coupled to elongated second circuit contacts which form the standard elongated leads of such dual in-line package extending externally from the opposite edges of the dual in-line package and which correspond in spacing to the first contacts in the housing, the key base having means on the platform for positioning the dual in-line package at a desired location with the second circuit contacts along the opposite edge portions of the platform, the second circuit contacts being bent over the edge portions and each fitting into one groove, and being exposed along the edge portions, said key assembly fitting through said opening and being positioned between the rows of first contacts and being rotatable when inserted into the interior of said housing to bring the portions of the second circuit contacts of the dual in-line package carried by the key assembly and exposed at said edge portions into electrical connection withe corresponding first contacts in the housing, the rows of first contacts yielding resiliently as the key assembly is rotated and the exposed portions of the second circuit contacts are brought into electrical connection with the first contacts.

2. The switch as specified in claim 1 wherein said first contacts in said housing comprise socket leads of a wire wrap socket, and the socket leads being mounted to provide a resilient force to urge the socket leads to engage the second circuit contacts carried by the key assembly.

3. The switch of claim 2 and a remote ribbon jumper cable connecting said socket to a circuit board at a remote location from said housing.

4. The switch of claim 1 wherein said key base comprises a cross sectional configuration that is nonsymmetrical in cross section, and said opening in said housing being oriented so that the key base is inserted in a first position and rotated 90° to bring the second circuit contacts into electrical connection with the first contacts in the housing.

5. The switch of claim 1 and including guide means to guide said key base for rotation about a known axis as the key is rotated substantially 90°.

6. An integrated circuit switch comprising a housing having an opening therein, a standard integrated circuit wire wrap socket mounted in said housing and having a pair of rows of generally parallel, spaced rows of coextensive elongated strip contacts extending outwardly from one side of the wire wrap socket, each row comprising a plurality of contacts spaced in direction along the row, a key assembly including a key body having a substantially planar exterior support surface and generally parallel side edges, a standard dual in-line package having an electrical circuit coupled to leads extending from the sides of the standard dual in-line package and corresponding in spacing to the strip contacts in the rows on the integrated circuit wire wrap socket, the key assembly having the dual in-line package supported on the exterior support surface with the leads thereof positioned along the side edges and bent around the side edges to hold the dual in-line package on the exterior support surface, the dual in-line package being held on the exterior of the key body only by the leads thereof being bent around the side edges, said key assembly fitting through said opening in the housing and being rotatable when inserted into the interior of said housing to bring the leads of the dual in-line package carried by the key assembly which are adjacent the side edges into electrical connection with corresponding elongated strip contacts in the housing, the strip contacts in the respective rows of strip contacts yielding and bearing against the dual in-line package leads as the key assembly is rotated.

7. The switch of claim 6 wherein said key base has a platform having the substantially planar exterior surface and side edges, said side edges having a plurality of preformed grooves defined therein, and spaced along the longitudinal axis of the key body at a spacing corresponding to the standard spacing of the circuit contact leads of said dual in-line package, each of the circuit contact leads being in a separate groove, the elongated strip contacts each fitting into one of the grooves on the side edges as the key assembly is rotated on the interior of the housing, and cooperating guide means between the housing and the key assembly to provide a known position of the grooves relative to the elongated strip contacts.

8. The switch of claim 7 and a remote jumper cable connectable to said socket at a first end and having a plug at its second end adapted for connection to a programming device.

9. The switch of claim 6 and means mounted on the housing for providing an electrical interlock when the key is in position with the electrical circuit contacts engaging the strip contacts.

10. The switch of claim 6 and resilient pad means extending along each of the rows of strip contacts to resiliently urge the strip contacts against the circuit contacts.

* * * * *